US005879004A

United States Patent [19]

Cote et al.

[11] Patent Number: 5,879,004

[45] Date of Patent: Mar. 9, 1999

[54] METHOD AND APPARATUS FOR CORRUGATING A FLAT MATERIAL

[75] Inventors: Kevin Lauren Cote, Durham, N.H.; David Crowell Emery, York, Me.

[73] Assignees: Heidelberg Harris Inc., Dover, N.H.; Heidelberger Druckmaschinen AG, Heidelberg, Germany

[21] Appl. No.: 822,091

[22] Filed: Mar. 20, 1997

[51] Int. Cl.[6] ..... B65H 29/70

[52] U.S. Cl. ..... 271/188; 271/209

[58] Field of Search ..... 271/188, 209, 271/161

[56] References Cited

U.S. PATENT DOCUMENTS

| | | | |
|---|---|---|---|
| 4,772,008 | 9/1988 | Spencer et al. | 271/188 X |
| 5,029,842 | 7/1991 | Belanger et al. | 271/188 |
| 5,107,733 | 4/1992 | Palmatier et al. | 83/176 |

FOREIGN PATENT DOCUMENTS 0 056 924 8/1982 European Pat. Off. .

*Primary Examiner*—David H. Bollinger
*Attorney, Agent, or Firm*—Burns, Doane, Swecker & Mathis

[57] ABSTRACT

The present invention relates to a method and apparatus for transporting a flat printed material being conveyed, such as a printed web of material, a ribbon, a signature, or the like. An exemplary apparatus includes a pair of seizing elements for transporting a web of material, and corrugation inducing elements arranged along a linear path adjacent to each other. The corrugation inducing elements are provided in a non-contacting manner on both sides of a transition area within which the flat printed material is conveyed, the corrugation inducing elements substantially extending along the transition area which is located between an output of the pair of seizing elements and the input to further processing elements to corrugate the flat printed material.

20 Claims, 5 Drawing Sheets

METHOD AND APPARATUS FOR CORRUGATING A FLAT MATERIAL

BACKGROUND OF THE INVENTION

1. Field of the Invention

The present invention is related to a method and apparatus for corrugating a flat material, such as a printed web in a folding apparatus assigned to a rotary printing press.

2. State of the Art

U.S. Pat. No. 5,029,842 relates to signature handling apparatus having a first conveyor which sequentially moves signatures to a discharge station. At the discharge station, the signatures are sequentially transferred to a receiving conveyor. A corrugator assembly is located at the discharge station to stiffen the signatures by forming corrugations which extend between leading and trailing end portions of the signatures. Although the corrugations are only temporarily maintained in the signature, the corrugator assembly is close enough to the receiving conveyor that a corrugation is maintained as a leading end portion of the signature moves to the receiving conveyor. Thus, the corrugator assembly is spaced from the receiving conveyor by a distance which is less than the distance between the leading and trailing end portion of the signatures.

U.S. Pat. No. 5,107,733 relates to an apparatus for cutting and transporting a paper web in a folding apparatus of a printing press. The apparatus includes a pair of cutting cylinders for cutting web sections from the web, and a transporting device for transporting the web sections away from the cutting cylinders. The first cutting cylinder has at least one cutting anvil, and the second cutting cylinder has at least one cutting knife which meets the cutting anvil at a nip between the cutting cylinders to cut the web moving through the nip. A plurality of strips are supported on the first cutting cylinder and a plurality of strips are supported on the second cutting cylinder. The strips have positions on the cutting cylinders at which they impress a temporary reinforcing profile onto each newly formed leading portion of the web, when the strips move through the nip. At least one smoothing surface is also supported on the first cutting cylinder and at least one smoothing surface is also supported on the second cutting cylinder. The smoothing surfaces have positions on the cutting cylinders, wherein the smoothing surfaces remove the temporary reinforcing profile from the leading portion of the web when the smoothing surfaces move through the nip.

The above-mentioned approaches impose a corrugated profile in order to stiffen the leading edge of a ribbon, web or signature by corrugating the ribbon, web, or signature with rollers having opposing large and small diameter sections. The roller surfaces can be steel brushes, Velcro-tape, or urethane, and must contact the ribbon, web or signature. This causes the roller surfaces to wear and can cause marking of the ribbon, or web signature. Different materials have consequently been used to prolong the life of the various roller components, although wear of these components still occurs.

Known corrugating methods also have a large sensitivity to position adjustments, and different designs have been developed in an effort to reduce the sensitivity of the position adjustments. Furthermore, known methods of corrugating induce corrugation locally, such that the corrugation effect must be projected to the location where it is required. Accordingly, it would be desirable to improve the corrugation of a flat material, such as a ribbon, web or signature.

SUMMARY OF THE INVENTION

Given the state of the art and the technical problems arising in the field, the present invention is directed to improving corrugation of a flat material, such as a web of material, a ribbon or a signature, by inducing a corrugation effect at a location where it is required.

A further object of the present invention is to produce a corrugation without contacting the flat material.

Another object of the present invention is to provide a corrugating method which is less sensitive to position adjustment.

According to the present invention, a method and apparatus are disclosed for transporting a flat printed material such as a printed web of material, a ribbon, a signature, or the like. An exemplary embodiment comprises:

a pair of seizing elements for conveying the flat printed material; and corrugation inducing elements arranged adjacent to each other along a linear path, said corrugation inducing elements being provided in a non-contacting manner on both sides of a transition area within which said flat printed material is to be conveyed, said corrugation inducing elements substantially extending along said transition area, which is located between an output of said pair of seizing elements and an input to further processing elements, to corrugate said flat printed material.

The present invention provides significant advantages. For example, the corrugation required for stiffening or stabilizing a flat material such as a web of material or ribbon is induced at the location where such stiffening is actually required. Furthermore, the stiffening can be achieved in a non-contacting manner so that the material is not damaged by marking, and so that components used to provide the stiffening are not subject to premature wear.

The corrugation inducing elements can, for example, be hollow members charged with a gaseous medium such as compressed air, or can be electrically charged bars (e.g., bars electrically charged positively or negatively). Thus, a non-contact corrugation of material to be conveyed can be achieved without having any corrugation inducing elements physically touch a surface of the material. Consequently, neither surface of the web is exposed to the risk of marking.

By arranging corrugation inducing elements in groups on either side of the material, a corrugating profile can be induced along an entire width of the material. For example, an evenly distributed reinforcing profile having peaks and valleys (i.e., a wave-shaped profile) can be used to significantly stiffen the leading edge of a web, ribbon or signature throughout the transition area.

The reinforcing profile can also be strengthened by having members of the groups of corrugation inducing elements arranged spaced apart from each other to extend the magnitude of corrugation. The spacing of the members of the groups of corrugation inducing elements can be used to arrange the peaks and valleys in a sinusoidal shape.

BRIEF DESCRIPTION OF THE DRAWINGS

The above-mentioned and other features, objects and advantages of this invention, and the manner of attaining them, will become more apparent from the following detailed description of exemplary embodiments when read in conjunction with the accompanying drawings, wherein.

DESCRIPTION OF PREFERRED EMBODIMENT

Figure 1:
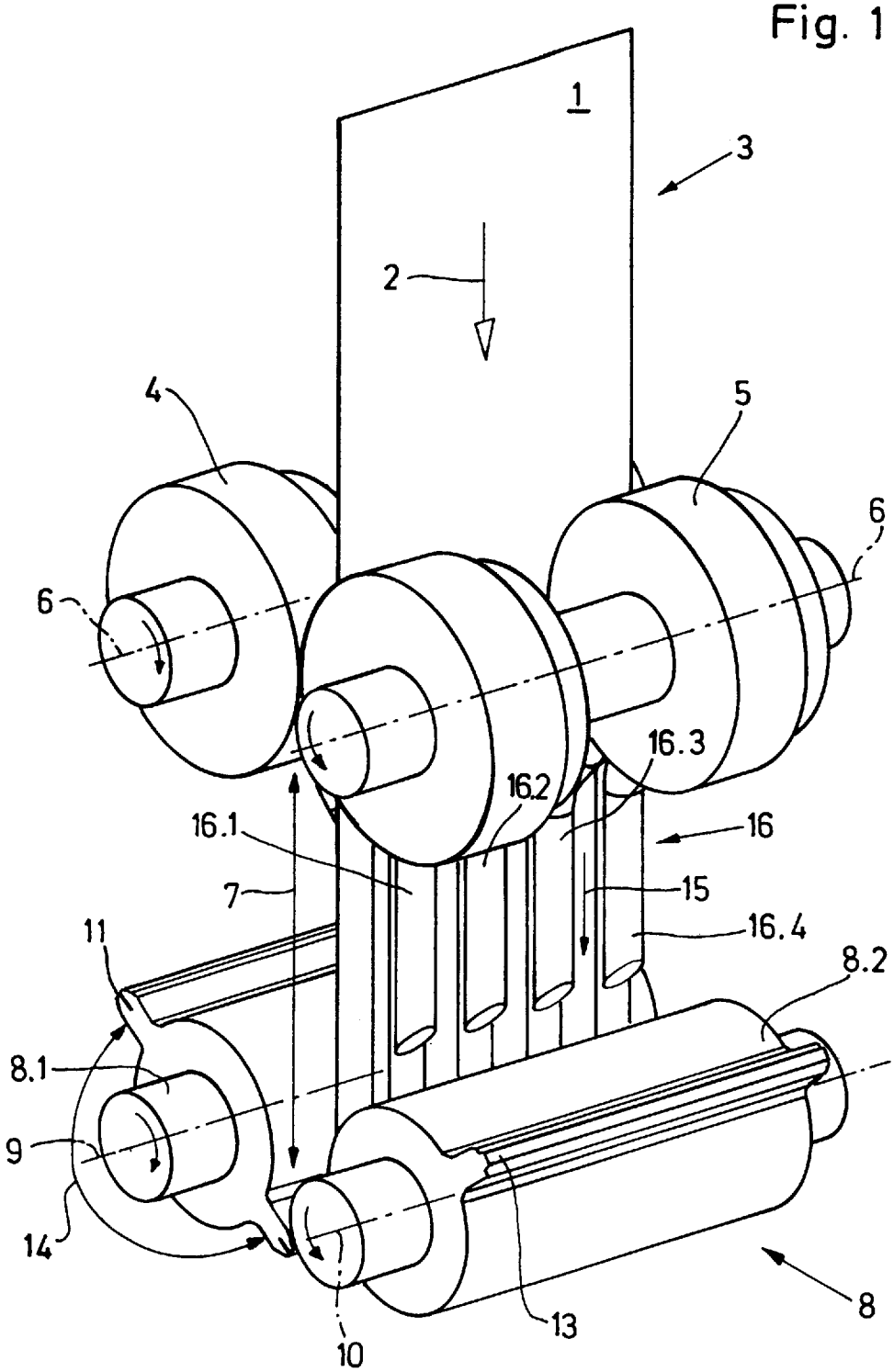
FIG. 1 shows a ribbon or a web of flat material being moved along a transition area.

FIG. 1 is a perspective view of a flat material, such as a web, ribbon or signature, to be conveyed along a conveying path extending substantially in a first (e.g., vertical) direction.

As shown in FIG. 1, a web of material 1 which is to be cut into signatures is pulled by seizing elements, such as a pair of nip rollers 4, 5, in a downward direction. The nip rollers 4, 5 rotate, as indicated by the arrows, about axes of rotation 6. A transition area 7 extends from a location of a nip defined by nip rollers 4, 5 to a location of further processing (e.g., conveying) elements, such as a pair of cutting cylinders 8. The pair of cutting cylinders 8 includes a knife cylinder 8.1 and an anvil cylinder 8.2. Both cylinders rotate about a respective axis of rotation 9, 10. On the circumference of the knife cylinder 8.1 are mounted two knives 11 which are arranged opposite each other. As can be derived from the FIG. 1 arrangement of knives 11 on knife cylinder 8.1, recesses 12 are established along the circumference of knife cylinder 8.1 between the knives 11. The arrangement of anvil bars 13 on the anvil cylinder 8.2 corresponds to the arrangement of the knives 11 on knife cylinder 8.1. Consequently, on the circumference of the anvil cylinder 8.2, recesses 14 are established.

Figure 2:
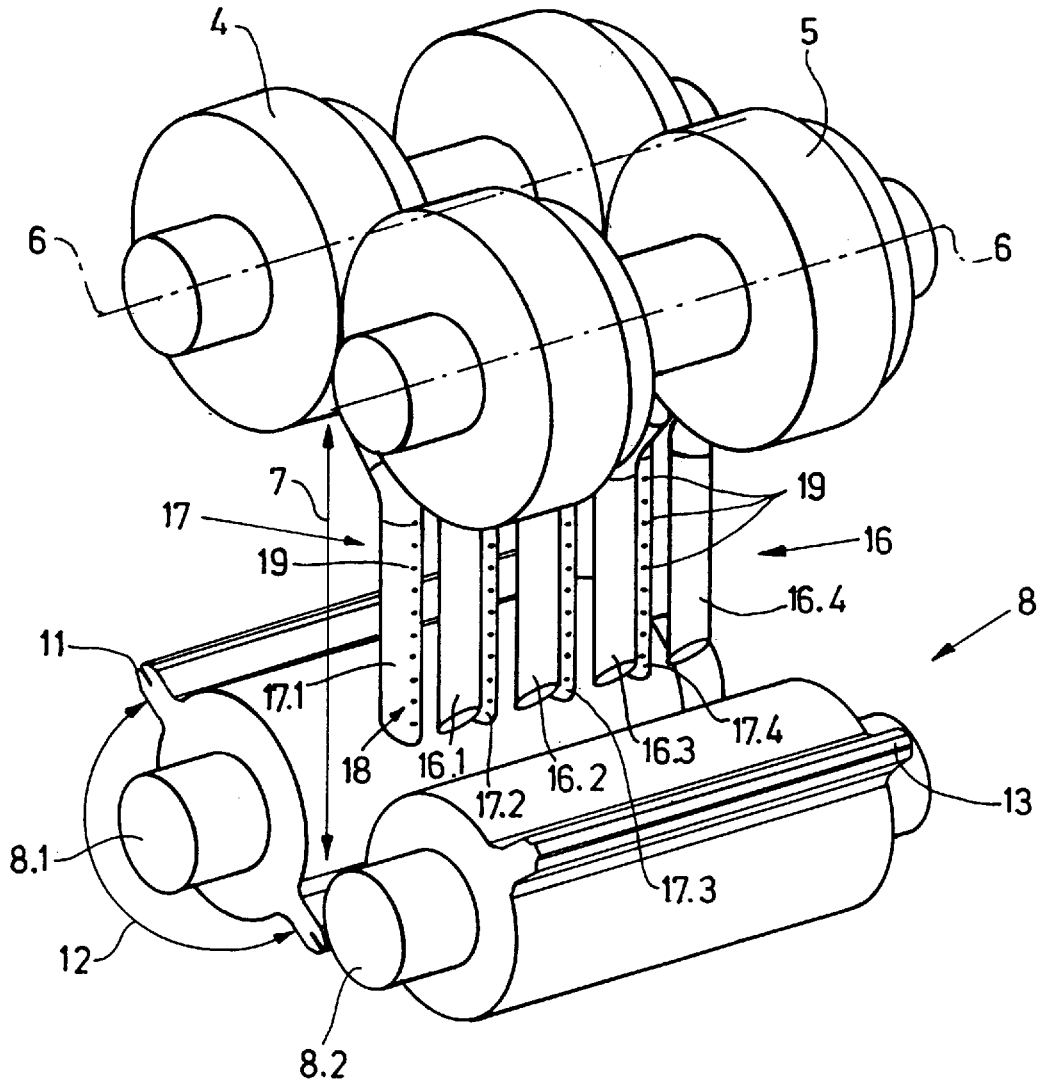
FIG. 2 shows an arrangement according to FIG. 1 with the web or ribbon removed to reveal a second group of corrugation inducing elements.

Through cooperation of the anvil bars 13 with the knives 11, signatures are severed from the web of material 1 after the web has been conveyed through transition area 7. According to exemplary embodiments of the present invention, the transition area 7 is bridged by two groups of corrugation inducing elements 16, 17 respectively, the corrugation inducing elements 17 being visible in the FIG. 2 illustration wherein the web 1 is not shown. In the partial view of FIG. 1, the first group 16 of corrugation inducing elements is shown to include four members 16.1 to 16.4, each being spaced from one other across a width of the web of material 1. Extended tube portions 23 (see FIG. 3) of the corrugation inducing elements 16.1 to 16.4 extend over a length of the transition area 7. In the FIG. 1 illustration, lower ends of the corrugation inducing elements reach into the nip between the pair of cutting cylinders 8. By having two groups 16, 17 of corrugation inducing elements arranged on either side of the web 1, a linear path 15 of the web extends substantially in vertical direction. The groups of corrugation inducing elements 16, 17 respectively, corrugate the web of material 1 conveyed within the transition area 7 where a stabilizing and a stiffening of the forward edge of web is needed; that is, prior to the transversal cut performed by the pair of cutting cylinders 8.

As mentioned previously, FIG. 2 shows the FIG. 1 arrangement with the web 1 removed to reveal the second group of corrugation inducing elements 17. In FIG. 2, the groups of corrugation inducing elements are arranged opposite each other. A plurality of apertures 19 are assigned to the corrugation inducing elements, the apertures being arranged in rows 18 over a length (e.g., the entire length) of lower tube portions 23 of corrugation inducing elements 16.1 to 16.4 and 17.1 to 17.4. As those skilled in the art will appreciate, at each desired location along a length of the lower tube portion 23, a row of one or more such apertures can be provided about a circumferential portion of the lower tube portion which faces an area where the web 1 is to be conveyed. The apertures themselves can, of course, be of any desired shape and size (e.g., round, slit-shaped, and so forth). As with the first group of corrugation inducing elements 16, the second group of corrugation inducing elements 17 includes four members 17.1 to 17.4.

The corrugation inducing elements 16.1 to 16.4 are arranged in a staggered fashion relative to corrugation inducing elements 17.1 to 17.4 to provide a corrugated profile of the web of material 1 over an entire width of the web of material. Because the corrugation inducing elements are arranged evenly spaced apart from each other, the material to be corrugated can adopt a wave-like (e.g., sinusoidal) shape. The corrugation inducing elements 16.1 to 16.4 and 17.1 to 17.4 are connected to an air supply which provides compressed air to the corrugation inducing elements 16.1 to 16.4 and 17.1. to 17.4. A continuously applied stream of air can thus be forced through the rows of apertures 18. Since the members 16.1 to 16.4 located on a first side of the transition area 7 and the members 17.1 to 17.4 located on a second side of the transition area 7 opposite the first side are, for example, in a staggered arrangement with respect to each other, the stream of air will provide air cushions in a wave shaped pattern for corrugation of the web of material 1 without requiring the corrugation inducing elements to physically contact the web.

Figure 3:
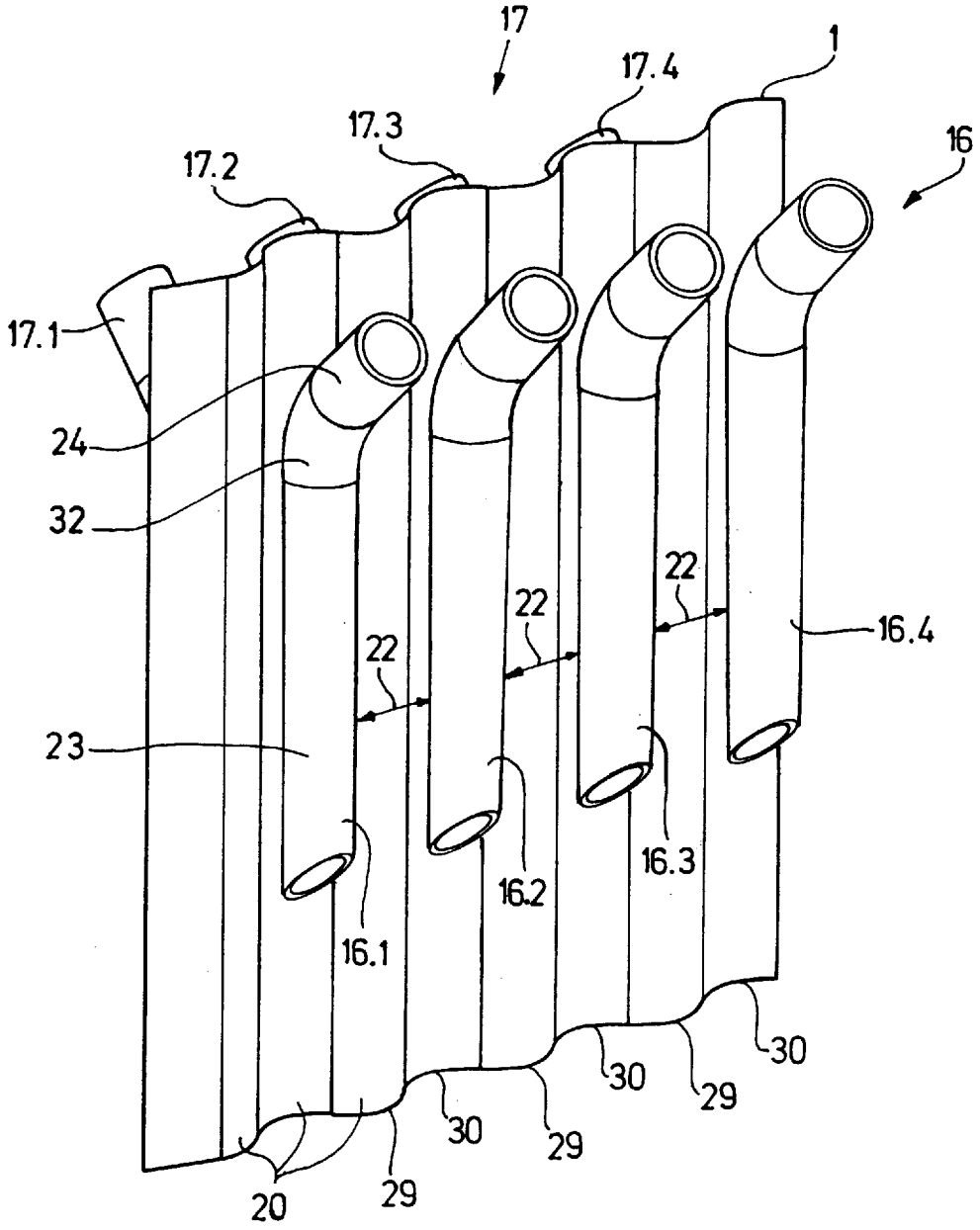
FIG. 3 shows a corrugated web of flat material, and corrugation inducing elements spaced apart from each other.

FIG. 3 is an enlarged view of both groups of corrugation inducing elements, shown in conjunction with a web of material. The first group of corrugation inducing elements 16 includes the members 16.1 to 16.4. Opposite the first group of corrugation inducing elements 16, the second group 17 is laterally staggered with respect to the first group 16 of corrugation inducing elements. Between the first and second groups of corrugation inducing elements 16, 17, the web of material 1 is shown to have adopted a corrugated state 20. The corrugated state 20 is characterized by respective peaks 29 and valleys 30. Given the corrugated state 20 in FIG. 3, as viewed from the side of the web on which corrugation inducing elements 16 are provided, the first member 17.1 of the second group of corrugation inducing elements 17 produces for a peak 29. Opposite the first member 17.1 is space to allow the web of material 1 to adopt the peak 29. In contrast, a valley 30 is formed with respect to the first element 16.1 of the first group of corrugation inducing elements 16, when viewed from the side of the transition area where the first group of corrugation inducing elements 16 are arranged.

As mentioned previously, the members 16.1 to 16.4 and 17.1 to 17.4 of the groups 16, 17 of corrugation inducing elements include an extended tube portion 23. The rows 18 of apertures 19 (FIG. 2) are arranged on a respective side of each extended tube portion 23 which faces the transition area where the web of material 1 is to be conveyed. As further shown in FIG. 3, the extended tube portions 23 are connected to upper tube portions 24 by curved portions 32. Via upper tube portions 24, an air supply is connected to the extended tube portions 23 bridging the transition area 7. The upper tube portions 24 of the second group 17 of corrugation inducing elements 17.1 to 17.4 are likewise connected to an air supply to generate air cushions along the rows 18 of apertures 19.

Figure 4:
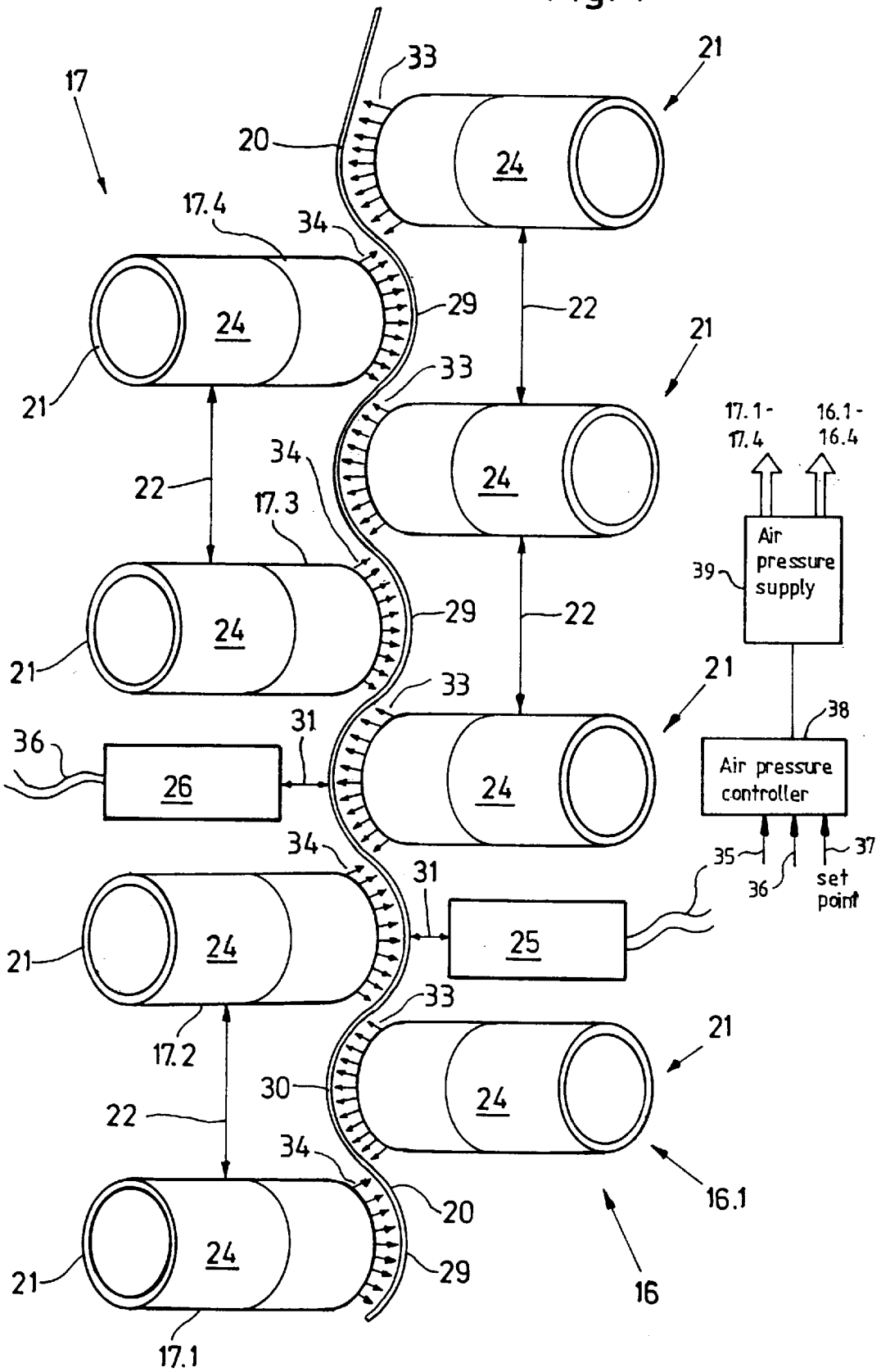
FIG. 4 shows sensors arranged to detect an induced magnitude of corrugation.

FIG. 4 shows an exemplary larger scale corrugated state of a web or ribbon of material to be conveyed. In the transverse sectional view of FIG. 4, the web 1 is shown to have adopted a corrugated state. In the exemplary FIG. 4 embodiment, the members 16.1 to 16.4 of the first group of corrugation inducing elements 16 are evenly spaced apart from one another in a direction represented by arrows 22. Air cushions 33 generated by each of the members 16.1 to 16.4 produce valleys 30 in the web of material 1. These "valleys", which protrude in a direction toward the second group of corrugation inducing elements can, of course, alternately be considered "peaks" when viewed from the side of web 1 on which corrugation inducing elements 17 are located. On the other hand, the corrugation inducing elements 17.1 to 17.4 located on the other side of web 1 generate air cushions 34 for producing peaks 29 with respect to the side of the web on which the first group 16 of corrugation inducing elements 16.1 to 16.4 is located. Thus, along an entire width of the web of material (or any desired portion thereof), a wave shaped pattern can be established to create a corrugated shape.

By means of sensors 25, 26 arranged on either side of the web of material 1, a magnitude of corrugation can be detected. The sensors 25, 26 respectively measure a distance 31 from a head of a given sensor to the surface of the web 1. As the distance 31 from sensor 26 to the corrugated web of material 1 becomes larger, the air pressure applied to members 16.1 to 16.4 of the first group 16 of corrugation inducing elements from an air pressure supply 39 (e.g., compressor) can be increased via an air pressure controller 38 to maintain a desired corrugation shape. The air pressure controller 38 can be configured in any manner readily apparent to those skilled in the art to compare feedback from the sensors 25, 26 with one or more setpoints 37 (e.g., a setpoint associated with each sensor) to provide conventional closed-loop feedback. Via a feedback system, the corrugation can be adjusted to a desired magnitude.

In the same way, the sensor 25 mounted on the web's other side will measure the magnitude of the distance 31 between the sensor's head and the surface of the web to be corrugated. The sensor 25 will adjust, via a feedback system, the air pressure within members 17.1 to 17.4 of the second group 17 of corrugation inducing elements. As those skilled in the art will appreciate, the sensors 25, 26 respectively can also be used not only to control an increase of air pressure on an opposite side of the web conveying plane—but also to control a decrease in air pressure on the side of the web on which each respective sensor 25, 26 is mounted. Alternately, the sensors can be used to control both an increase in air pressure on one side and a decrease on the other side in any manner desired by the user to achieve any desired corrugation shape.

Figure 5:
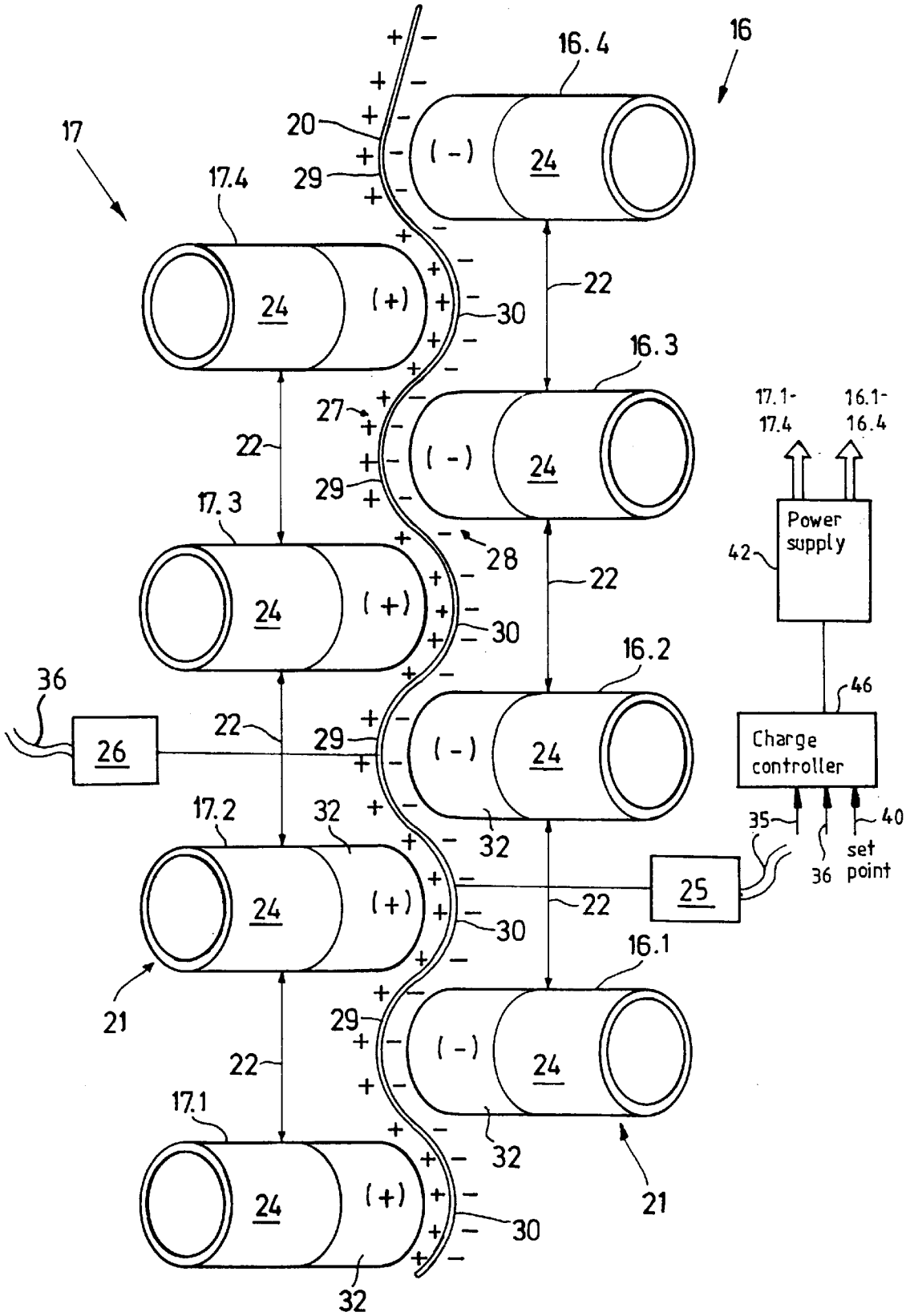
FIG. 5 shows said corrugation inducing elements arranged on either side of the web being electrically charged.

Another exemplary embodiment of the present invention is shown in FIG. 5, wherein negatively and positively charged bars are used to induce a corrugation profile. In the FIG. 5 embodiment, the members 16.1 to 16.4 of the first group 16 of corrugation inducing elements are not connected to an air supply. Rather, the respective extended tube or bar portions 23 of FIG. 3 are negatively or positively charged. As already described in detail above, the members 16.1 to 16.4 can be evenly spaced from one another. In the FIG. 5 embodiment, one side of the web of material 1 can be negatively charged, while the other side thereof can be positively charged (or vice versa).

In the FIG. 5 embodiment, the second group 17 of corrugation inducing elements including members 17.1 to 17.4 can be charged positively and arranged spaced apart from each other. The first group 16 of corrugation inducing elements can also be spaced apart in the manner described with respect to the FIG. 4 embodiment, but can be charged negatively. Upon passage of the web of material 1, a repulsive force is created on either side of the web to produce a wave (e.g., sinusoidal) shape of the web, and to prevent physical contact between the web surfaces and the bars of the groups 16, 17 of corrugation inducing elements. As described with respect to FIG. 4, sensors 25, 26 can be arranged on either side of the web 1 to provide feedback for regulating the corrugation profile via use of a closed-loop feedback control that includes a charge controller 41, and a power supply 42, in conjunction with one or more setpoints 40. As with the FIG. 4 embodiment, each sensor can be used to control the distance between the sensor and a corrugated surface of the web or the ribbon.

The sensors 25, 26 can be used to control and adjust the respective charge load on each corrugation inducing element to maintain a desired preset distance 31 (i.e., corrugation magnitude) between each of the first and second groups 16, 17 of corrugation inducing elements relative to a respective side or sides of the web. As with the FIG. 4 embodiment, sensor 25 can be used to control the charge on either or both sides of the web. Similarly, the sensor 26 can be used to control the charge on either or both sides of the web.

As those skilled in the art will appreciate, the embodiments described above are by way of example only, and numerous variations exist. For example, rather than using the two sensors 25 and 26, a single sensor can be used to control the profile by allowing the single sensor to adjust the compressed air or charge on both sides of the web. As those skilled in the art will further appreciate, a plurality of the sensors 25, 26 can be included on both sides of the web to enhance the accuracy with which a desired corrugation profile is shaped.

It will also be apparent to those skilled in the art that although exemplary embodiments have been described for producing a sinusoidally-shaped profile, any desired profile can be produced using a method and apparatus in accordance with the present invention. For example, corrugation inducing elements can be randomly placed on either side of the web 1. Further, the extended tube portions 23 need not be shaped as cylindrical tubes, but rather can be shaped as desired. For example, if the shape of these portions 23 is non-cylindrical (e.g., for example), box-shaped, then apertures can be located on a periphery thereof to create a more square-shaped profile of the web. Numerous variations will, of course, exist and be apparent to those skilled in the art.

As those skilled in the art will also appreciate, the amount of corrugation introduced to the flat printed material can be randomly changed by the user in real time, during processing of the material. Such changes in the corrugation can, of course, be effected remotely by changing the setpoint(s). The use of such closed-loop feedback control, as described in accordance with exemplary embodiments of the present invention, reduces and/or eliminates the setting sensitivity that conventional systems experience, and permits compensation for changes in material conveyance, speed, tension changes and other time varying parameters.

As those skilled in the art will appreciate, rather than using a plurality of rows apertures formed in a column along a length of the tube portion 23, a single slit shaped aperture can be provided along a length of the tube. Alternately, multiple longitudinal slits can be included on each tube portion 23.

It will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalents thereof are intended to be embraced therein.

What is claimed:

1. Apparatus for transporting a flat printed material comprising:

a pair of seizing elements for conveying the flat printed material; and corrugation inducing elements arranged adjacent to each other along a linear path, said corrugation inducing elements being provided in a non-contacting manner on both sides of a transition area within which said flat printed material is to be conveyed, said corrugation inducing elements substantially extending along said transition area, which is located between an output of said pair of seizing elements and an input to further processing elements, to corrugate said flat printed material without physically contacting said flat printed material.

2. Apparatus according to claim 1, wherein said corrugation inducing elements are hollow members charged with a gaseous medium.

3. Apparatus according to claim 2, wherein said hollow members are connected to an air supply.

4. Apparatus according to claim 3, wherein said hollow members include at least one aperture facing said transition area.

5. Apparatus according to claim 4, wherein said at least one aperture is slit shaped in a direction substantially extending along a direction of conveyance of said flat printed material.

6. Apparatus according to claim 4, wherein a plurality of said apertures are arranged as a rows of apertures along a direction of conveyance of said flat printed material.

7. Apparatus according to claim 2, wherein on at least one side of said transition area, sensor means are provided for detecting a corrugation magnitude of the flat printed material.

8. Apparatus according to claim 7, wherein said sensor means includes at least one sensor arranged on a first side of said transition area for controlling air pressure of a first group of said corrugation inducing elements located on a second, opposite side of said transition area.

9. Apparatus according to claim 8, wherein said sensor means includes at least one additional sensor arranged on said second side of said transition area for controlling air pressure of a second group of said corrugation inducing elements located on said first side.

10. Apparatus according to claim 8, wherein said at least one sensor controls the air pressure of said first group and of a second group of said corrugation inducing elements located on the first side of said transition area.

11. Apparatus according to claim 1, wherein said corrugation inducing elements are electrically charged bars.

12. Apparatus according to claim 11, wherein on at least one side of said transition area, sensor means are provided for detecting a corrugation magnitude of the flat printed material.

13. Apparatus according to claim 12, wherein said sensor means includes at least one sensor arranged on a first side of said transition area for controlling electrical charge of a first group of said corrugation inducing elements located on a second, opposite side of said transition area.

14. Apparatus according to claim 13, wherein said sensor means includes at least one additional sensor arranged on said second side of said transition area for controlling electrical charge of a second group of said corrugation inducing elements located on said first side.

15. Apparatus according to claim 13, wherein said at least one sensor controls the charge load of said first group and of a second group of said corrugation inducing elements located on the first side of said transition area.

16. Apparatus according to claims 1, wherein said corrugation inducing elements are arranged in groups on either side of said flat printed material.

17. Apparatus according to claim 16, wherein members of a first group of said corrugation inducing elements are spaced apart from each other over a width of a first side of said transition area.

18. Apparatus according to claim 17, wherein members of a second group of said corrugation inducing elements are spaced apart from each other over a width of a second side of said transition area.

19. Apparatus according to claim 18, wherein said members of said first group of corrugation inducing elements are staggered with respect to members of said second group of corrugation inducing elements.

20. Method for transporting a flat printed material comprising the steps of:

seizing a flat printed material for conveyance to further processing elements; and corrugating said flat printed material, while said flat printed material is conveyed along a linear path to said processing elements, without physically contacting said flat printed material.

* * * * *